United States Patent [19]

French et al.

[11] 3,984,277

[45] Oct. 5, 1976

[54] LABEL APPLICATOR

[75] Inventors: John B. French, Hacienda Heights; Hubert J. Schroeder, Seal Beach, both of Calif.

[73] Assignee: Compac Corporation, Montebello, Calif.

[22] Filed: Sept. 15, 1972

[21] Appl. No.: 289,349

[52] U.S. Cl. ..... 156/497; 156/541; 156/DIG. 33; 156/DIG. 38

[51] Int. Cl.[2] ..... B65C 9/18; B65C 9/28

[58] Field of Search ..... 156/540, 541, 542, 497, 156/361, 363, DIG. 38, DIG. 33, DIG. 31; 221/278

[56] References Cited

UNITED STATES PATENTS

| | | | |
|---|---|---|---|
| 3,093,528 | 6/1963 | Reich | 156/541 |
| 3,238,080 | 3/1966 | Schlutter | 156/541 |
| 3,329,550 | 7/1967 | Kucheck | 156/541 |
| 3,379,466 | 4/1968 | Hughes | 156/DIG. 38 |
| 3,483,059 | 12/1969 | Dinter | 156/542 |
| 3,562,067 | 2/1971 | Kucheck | 156/542 |
| 3,645,832 | 2/1972 | Sauer | 156/541 |

*Primary Examiner*—Douglas J. Drummond
*Assistant Examiner*—Jerome W. Massie
*Attorney, Agent, or Firm*—Gordon L. Peterson

[57] ABSTRACT

A label applicator for applying a label to an article comprising a supporting structure, a manifold defining an air chamber mounted on the supporting structure, and a plurality of conduits communicating with the air chamber. Some of the conduits are blocked off and other of the conduits are capable of transmitting a blast of air from the air chamber toward the label to remove the label and apply it to an article.

10 Claims, 10 Drawing Figures

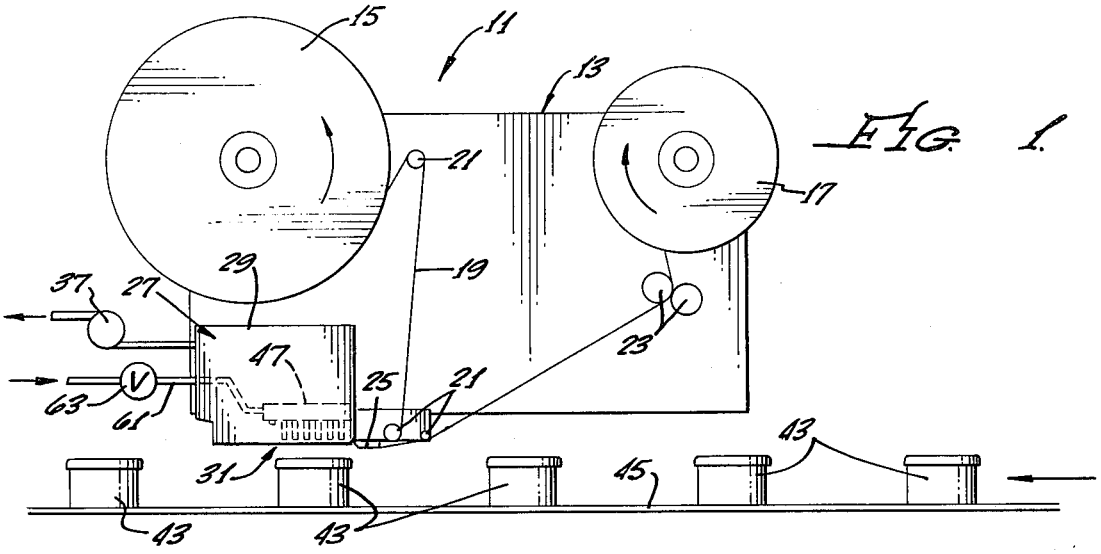
FIG. 1.
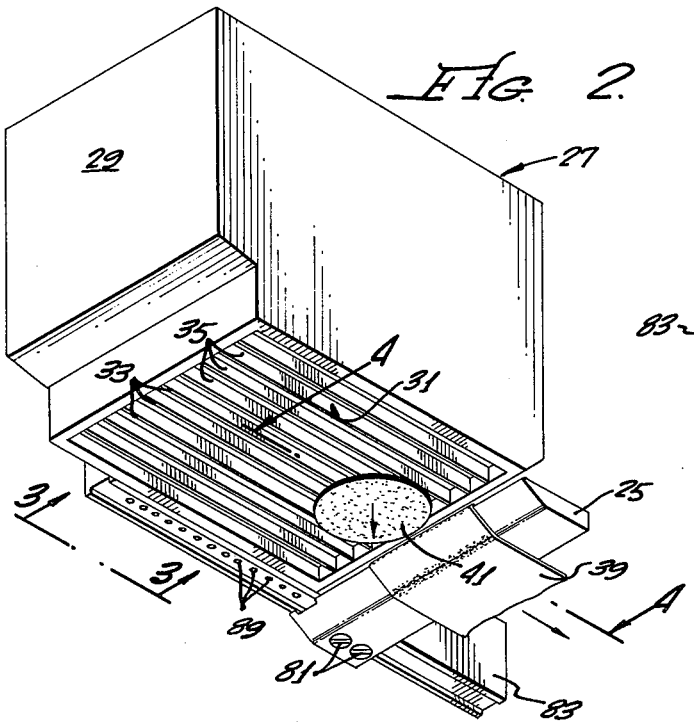
FIG. 2.
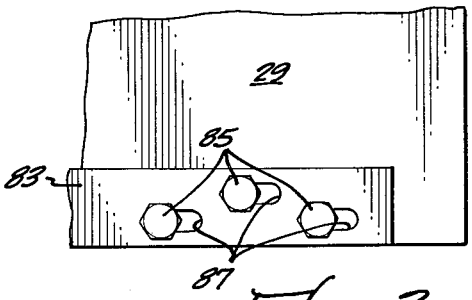
FIG. 3.
FIG. 4.
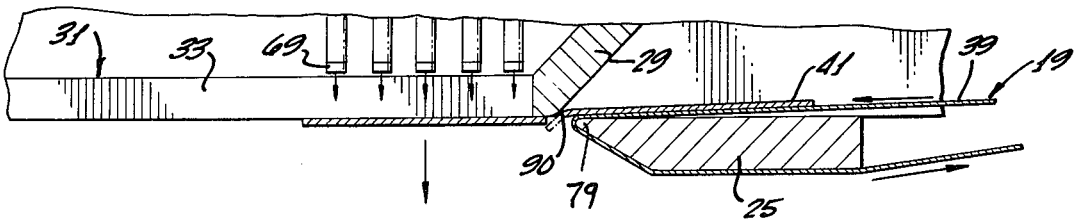

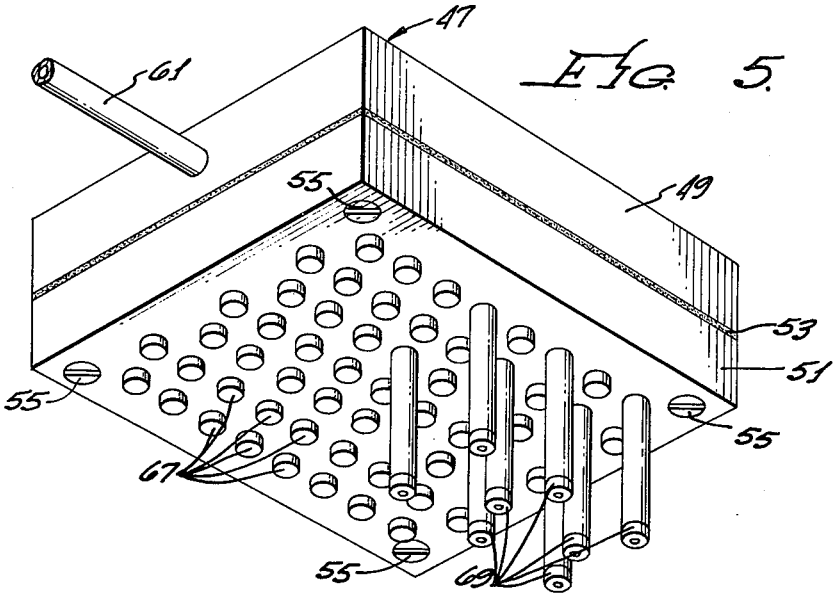
FIG. 5.
FIG. 6.
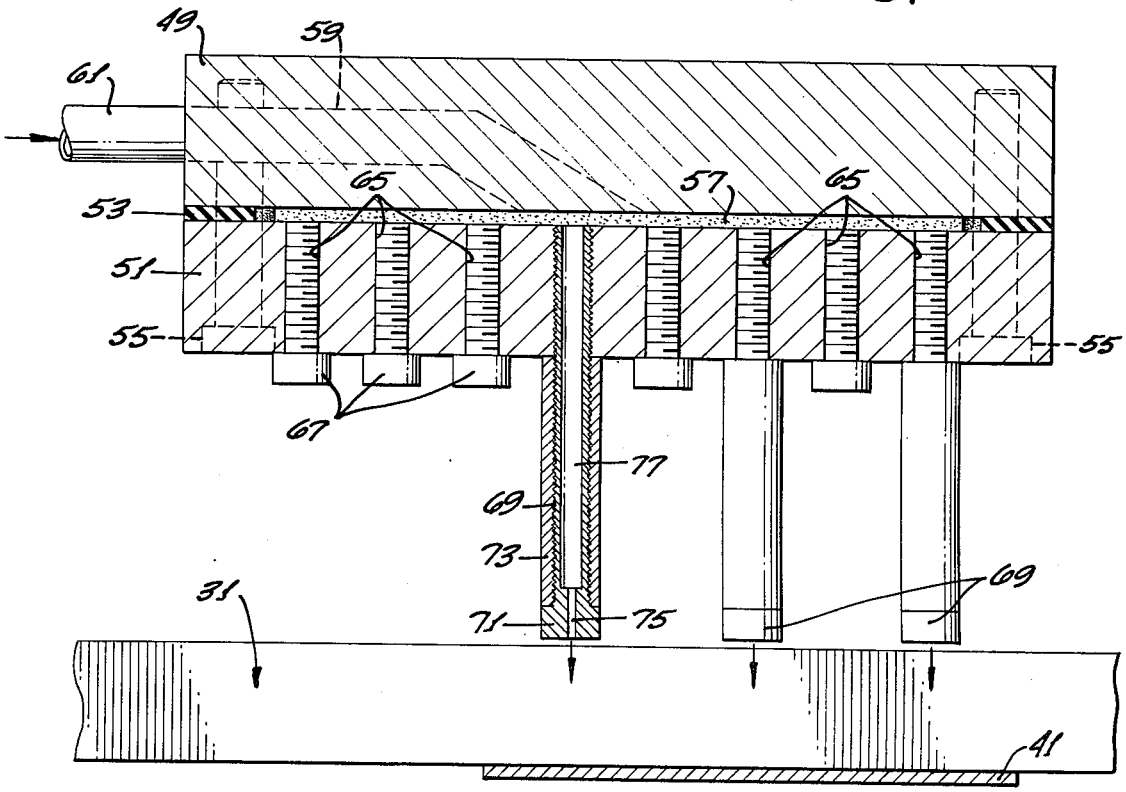

FIG. 7.
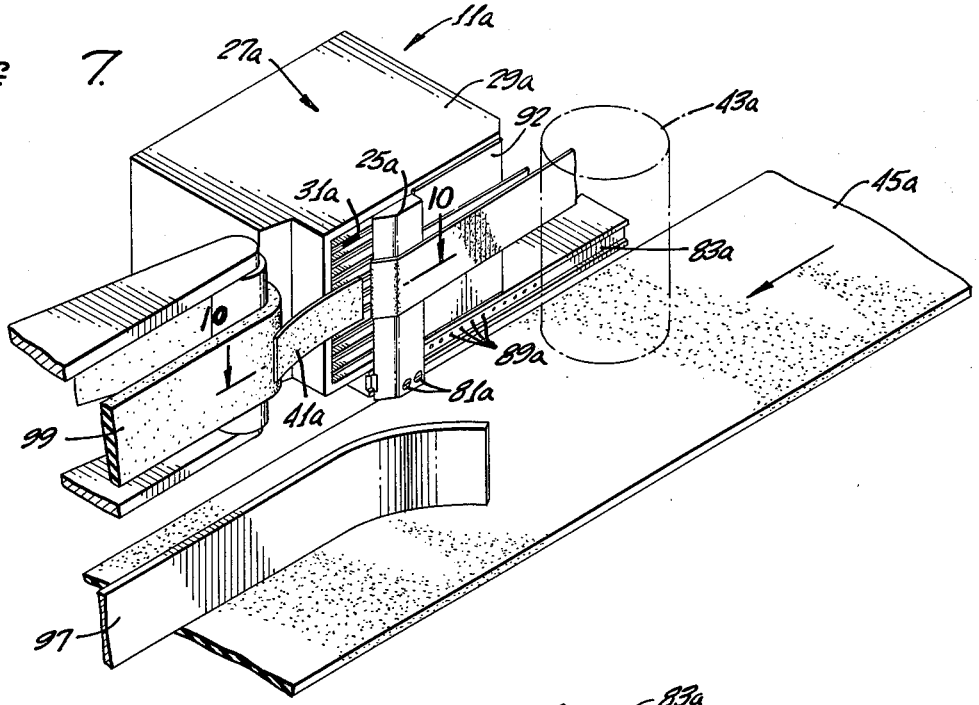
FIG. 9.
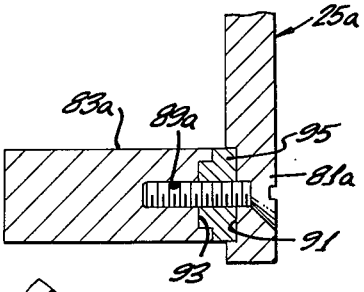
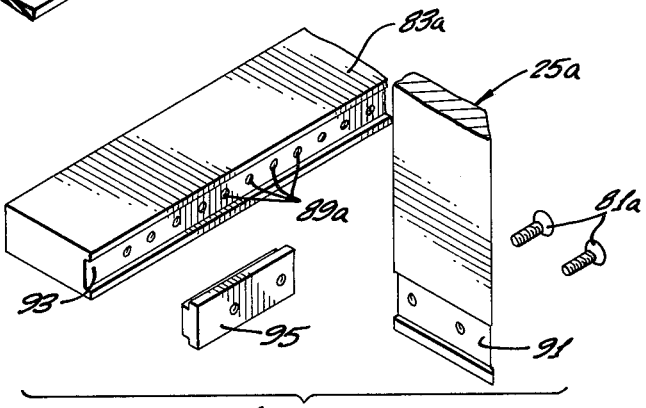
FIG. 8.
FIG. 10.
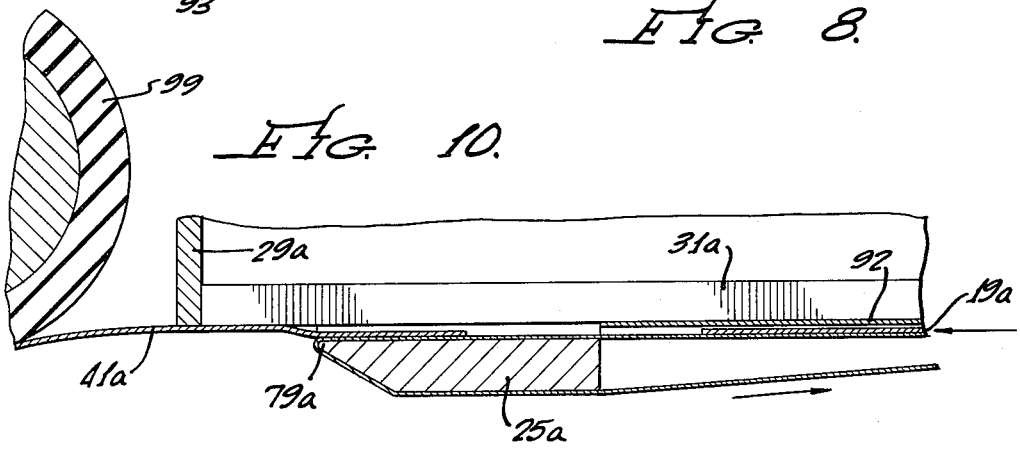

LABEL APPLICATOR

BACKGROUND OF THE INVENTION

Many articles such as containers for products and/or the products themselves must bear a label providing pricing information, product identification, etc. The labels are typically supplied on an elongated backing strip with the labels being adhesively secured to the backing strip. The labelling function is carried out by a label applicator which removes the labels and applies them to the articles as the articles are conveyed by the applictor.

It is common practice to use a peeling bar to remove the labels from the backing strip. The removed label is then held against a grid by suction or vacuum pressure until a blast of air removes the label from the grid and blows the adhesive side of the label against an article to attach the label to the article.

This construction works very well for many applications. However, it is not as effective as desired for labels of different sizes and shapes and for articles of certain configurations. For example, the prior art construction is not adapted for use in applying a label to a surface, such as a cylindrical surface, which is constructed so as to be at varying distances from the grid. In this instance, the portions of the label which are to be adhered to remote regions of the surface may not be attached to the container.

SUMMARY OF THE INVENTION

The present invention provides a label applicator in which the removing air blast can be quickly tailored to accommodate surfaces of different configurations and labels of different sizes and shapes. This can be accomplished by providing a header or air manifold which defines an air chamber therein and which is adapted to receive air under pressure. A plurality of conduits communicate with the air chamber and extend generally toward a preselected location at which a label is being releasably retained. Some of the conduits are blocked off so that substantially no air can be transmitted therethrough. Other of the conduits are open so that they are capable of transmitting a blast of air from the air chamber toward the label to remove the label and apply it to the article.

A feature of the invention is that the conduits can be quickly and easily blocked or unblocked so that the shape of the air pattern provided thereby can be tailored. For example, the air removal pattern could be made of a first configuration for a small circular label by blocking and unblocking appropriate conduits and made of a second configuration to accommodate, for example, an elongated rectangular label by blocking and unblocking other of the conduits.

The force generated by the air blast at any location throughout the air pattern can also be adjusted to suit specific requirements. For example, when the label is to be applied to an irregular surface, the air pattern is tailored so that greater quantities of air are applied to regions of the label which are to be adhered to relatively remote regions of the surface. This can be accomplished by blocking off appropriate conduits and/or by varying the cross sectional areas of the conduits.

To facilitate rapid changing of the shape of the air pattern, the air manifold includes a wall with a plurality of ports extending therethrough. The conduit blocking means includes plugs threadedly received in the ports.

The unblocked conduits include the ports and tubes threadedly attached to the wall of the air manifold. To plug a conduit, it is only necessary to remove the tube and insert a plug into the port.

To assure that all of the unblocked conduits provide their proportionate share of the air blast, it has been found that the outlet sections of the passages through each of the conduits should be of lesser cross sectional area than the region of the passage immediately adjacent thereto. If all of the passages are of equal diameter, some of the passages remote from the air inlet to the air chamber are "starved".

In a preferred construction, the air manifold includes a pair of outer plates and an intermediate plate with the intermediate plate sandwiched between the outer plates. The intermediate plate has a cutout region so that the three places define the air chamber. One of the outer plates has the ports therein. The intermediate plate is preferably a resilient gasket which also provides a sealing function.

Pressure sensitive adhesive labels are applied using a spot labelling technique or a wraparound technique. In the spot labelling technique, the article to which the label is applied is normally stationary, and the label is blown on or mechanically pushed against the article. In the wraparound technique, the container to which the label is to be applied is rotated, and the label is wrapped around at least a portion of the circumferential periphery of the container. These two techniques inherently require that the peeling bar be located in different positions. For this reason, it has not been possible heretofore to use basically the same machine for spot labelling and for wraparound labelling.

With the present invention, however, the position of the peeling bar is adjustable so that a major portion of the labelling machine can be used for either spot labelling or wraparound labelling. This can be accomplished by providing a track with a capability of mounting the peeling bar at several different locations relative to the grid. For spot labelling, the peeling bar is ordinarily positioned adjacent one end of the grid, and for wraparound labelling, the peeling bar normally extends transversely at least part way across the grid intermediate the ends thereof.

A spacer is provided to enable the position of the peeling bar to be adjusted in a direction axially of the grid. This adjustment is desirable to avoid interference between labels resulting from overfeed.

The invention can best be understood by reference to the following description taken in connection with the accompanying illustrative drawings.

BRIEF DESCRIPTION OF THE DRAWINGS

FIG. 1 is a side elevational view of a label applicator constructed in accordance with the teachings of this invention with the applicator arranged to carry out a spot labelling function.

FIG. 2 is a perspective view of a portion of the label applicator.

FIG. 3 is a fragmentary elevational view taken in the direcction of the arrows 3—3 in FIG. 2.

FIG. 4 is a sectional view taken generally along line 4—4 of FIG. 2.

FIG. 5 is a perspective view of the air manifold.

FIG. 6 is a sectional view through the air manifold with portions thereof being shown in side elevation.

FIG. 7 is a perspective view of a wraparound label applicator constructed in accordance with the teachings of this invention.

FIG. 8 is an exploded fragmentary perspective view of the peeling bar and the peeling bar mounting means.

FIG. 9 is a fragmentary sectional view showing how the peeling bar is mounted.

FIG. 10 is an enlarged fragmentary sectional view taken generally along line 10—10 of FIG. 7.

DESCRIPTION OF THE PREFERRED EMBODIMENT

FIG. 1 shows a label applicator 11 which includes a supporting structure 13. A storage reel 15 and a takeup reel 17 are rotatably mounted on the supporting structure 13. An elongated strip 19 of labels is wound on the storage reel 15 and extends over a plurality of guide rollers 21 and in between a pair of drive rollers 23 to the takeup reel 17. The drive rollers 23 rotate to pull the strip 19 off of the storage reel 15 to rotate the latter. The takeup reel 17 is caused to rotate in accordance with the amount of the strip 19 which is supplied thereto, all of which can be accomplished in a manner well known in the art. The strip 19 is also caused to pass over a peeling bar 25 in moving between the reels 15 and 17.

The label applicator 11 also includes an applicator section 27 (FIGS. 1 and 2). The applicator section 27 includes a housing 29 which is substantially sealed except for the lower end thereof which is covered by a gas previous wall such as a grid 31. In the embodiment illustrated, the grid 31 includes a plurality of longitudinally extending, spaced, parallel slats 33 defining slots 35 therebetween. The housing 29 is evacuated to less than atmospheric pressure by a motor driven fan 37, and accordingly there is a vacuum or slight negative air pressure at the grid 31.

The strip 19 includes a backing strip 39 (FIGS. 2 and 4) and a plurality of labels 41 adhered to the backing strip. When the strip 19 passes over the peeling bar 25, the strip 19 is forced to undergo a reverse bend with the result that the label 41 is removed from the backing strip 39 at a location immediately beneath, and adjacent one end of, the grid 31. The negative air pressure at the grid 31 causes the label 41 to be retained against the lower face of the grid.

A plurality of articles or containers 43 are positioned on a conveyor 45 and pass beneath the grid 31. The conveyor 45 moves one of the containers 43 directly beneath the label 41 which is retained on the grid 31. A header or air manifold 47 (FIGS. 1, 5 and 6) suitably mounted within the housing 29 blows the label 41 from the grid 31 and onto the upper surface of the article 43 therebelow. The blast of air is provided automatically by the manifold 47 in response to the presence of a container 43 being beneath the label 41 on the grid 31. Although the labels 41 are shown as being applied to the upper surface of containers 43, it should be understood that the label applicator 11 can be used to apply labels of different sizes and shapes to various surfaces of different configurations.

A preferred construction of the manifold 47 is shown in FIGS. 5 and 6. The manifold 47 includes an upper plate 49, a lower plate 51, and an intermediate plate 53 in the form of a flexible resilient sealing gasket. The plates 49, 51 and 53 are interconnected in any suitable manner such as by screws 55. The plates 49 and 51 may be constructed of a suitable metal. The intermediate plate 53 is cut away in the central region thereof so that that the plates 49, 51 and 53 define upper, lower and peripheral walls, respectively, of an air chamber 57. The air chamber 57 is sealed by the plate 53.

The air chamber 57 is supplied with air through a passage 59 formed in the upper plate 49 and a conduit 61 (FIGS. 1, 5 and 6). A valve 63 (FIG. 1) in the conduit 61 is automatically opened to cause air under pressure to be supplied through the valve, the conduit 61, and the passage 59 to the air chamber 57.

The lower plate 51 has a plurality of ports 65 with the outer ends of the ports being formed with internal screw threads. Threaded plugs 67 having external screw threads are received in some of the ports 65 to block these ports and prevent air in the chamber 57 from passing out through them. Tubes 69 having external screw threads are threaded into some of the other ports 65 so that all of the ports 65 are either plugged by one of the plugs 67 or have one of the tubes 69 attached thereto. The threads on the plugs 67 and the tubes 69 are preferably identical. Each of the tubes 69 has an annular shoulder 71 at the outer end thereof. A sleeve-like spacer 73 surrounds each of the tubes 69 and is retained between the shoulder 71 and the lower face of the plate 51. The spacer 73 is sized so as to prevent the tube 69 from entering the air chamber 57 and to keep the tube flush with the inner face of the plate 51. The plugs 67 are flush with the inner face of the plate 51 to prevent the ports 65 from increasing the volume of the air chamber 57.

Each of the tubes 69 cooperates with the associated port 65 to define a conduit or air passage leading from the air chamber 57 and projecting toward a label 41 on the grid 31. The tube 69 defines an outlet section 75 of this passage which is of lesser diameter than the adjacent section 77 of the passage in the tube and of lesser diameter than the associated port 65. Preferably the tubes 69 extend to a location closely adjacent the label 41, and in the embodiment illustrated, the tubes terminate slightly upwardly of the upper plane of the grid 31. The tubes 69 are preferably arranged so that the outlet sections 75 thereof are in registry with the slots 35.

The manifold 47 is fixedly mounted within the housing 29. Preferably the manifold 47 can be moved longitudinally of the slots 33 as disclosed in applicant's U.S. Pat. No. 3,728,362.

The peeling bar 25 is in the form of an elongated bar having a relatively narrow edge 79 (FIG. 4) over which the backing strip 39 is pulled. The peeling bar 25 is mounted by a pair of screws 81 (FIG. 2) to a track 82. The track 83 is in turn mounted on the housing 29 as shown in FIG. 3 by threaded fasteners 85 which project through slots 87 in the track 83. This permits the track 83 to be moved relative to the grid 31 in the direction longitudinally of the slats 33.

As shown in FIG. 2, the track 83 has a plurality of longitudinally spaced, tapped holes 89 of a size to receive the screws 81. Thus, the peeling bar 25 can be mounted at various positions along the track 83 relative to the grid 31. For spot labelling it is preferred to mount the peeling bar 25 in the position shown in FIGS. 1–4. In this position, the edge 79 is located at or slightly above the plane of the lower face of the grid 31 and closely adjacent but outside of one edge of the grid 31. This allows the labels 41 to be fed onto the lowere face of the grid 31 as shown in FIGS. 2 and 4.

The track 83 locates the upper surface of the peeling bar 25 in substantially the plane of the outer face of the grid 31. The peeling bar 25 is located so that, as the label 41 is removed from the backing strip 39, it strikes a camming surface 90 which directs the label 41 downwardly away from the grid 31 as shown in dashed lines in FIG. 4. Thus, if some overfeed occurs, the label partially peeled from the strip 19 will not interfere with blowing of the label from the grid 31.

In operation of the label applicator 11, the strip 19 is moved intermittently from the storage reel 15 to the takeup reel 17 and this results in one of the labels 41 being removed from the backing strip 39 and retained against the lower face of the grid 31 by the vacuum within the housig 29. The conveyor 45 also moves one of the containers 43 to a location immediately beneath the label 41 on the grid 31. When this has occurred, the valve 63 is automatically opened to provide a blast or pulse of air to the air chamber 57. The air travels through the unblocked ports 65, the passage sections 77 and 75 and is discharged against the upper face of the label 41. Substantially none of the air from the air chamber 57 passes through the ports 65 which are blocked by the plugs 67. This air blast is sufficient to remove the label 41 from the grid 31 even though the vacuum within the housing 29 is not terminated during this period. The label 41 is blown from the grid 31 against the container 43 with sufficient force to cause the adhesive on the label to adhere to the container. The movements of the strip 19 and the conveyor 45 and the sequencing of the valve 63 cana be controlled in any suitable manner such as that described in applicant's U.S. Pat. No. 3,729,362.

The pattern of the air blast from the manifold 47 can be changed by removing one or more of the plugs 67 and inserting one of the tubes 69 and/or by removing one or more of the tubes 69 and replacing it with one of the plugs 67. In this manner, the air pattern can be tailored to the size and shape of the label 41. The force exerted by the air at various locations throughout the air pattern can be adjusted by employing tubes 69, the outlet sections 75 which are of different cross sectional areas. Thus, to increase the force of the air at a given location, a tube 69 having an outlet section 75 of relatively large cross sectional area would be used. Blocking and unblocking of the ports 65 also can be used to control the force distribution of the air throughout the pattern.

By providing the passage section 77 with a larger cross sectional area than the outlet section 75, assurance is provided that all of the tubes 69 transmit air in meaningful quantities toward the label 41. If the passages through the tubes 69 were of constant diameter, then at least some of the tubes remote from the location at which the passage 59 opens into the air chamber 57 may supply significantly less than their proportionate share of air to the label 41. The stepped passages through the tubes 69 assure that the air flow can be readily predicted by the location of the tubes 69.

FIGS. 7–10 show how the features of the present invention can be applied to a wraparound label applicator 11*a*. Portions of the wraparound label applicator 11*a* corresponding to portions of the label applicator 11 are designated by corresponding reference numerals followed by the letter *a*.

The label applicator 11*a* includes an applicator section 27*a* which is identical to the applicator section 27 except that in lieu of the conduits a latterly adjustable mask 92 be added, the said mask being adjustable for blocking and unblocking the slots 31*a*, and the peeling bar 25*a* is mounted at a different location. Specifically, the peeling bar 25*a* extends transversely across the grid 31*a* at a location intermediate the ends of the grid. The peeling bar 25*a* may be identical to the peeling bar 25 and includes a channel 91 extending in a direction longitudinally of the track 83*a*. The track 83*a* is identical to the track 83 and includes a longitudinally extending groove 93 in which the drilled and tapped holes 89*a* are provided.

The applicator 11*a* differs from the applicator 11 in including a spacer 95 which is received in the channel 91 and in the groove 93 to thereby space the peeling bar 25*a* from the track 83*a*. The spacer 95 moves the peeling bar 25*a* away from the grid 31*a* in a direction parallel to the axis of the grid, i.e., transverse to the grid. Thus, the peeling bar 25*a* is spaced outwardly from the outer plane of the grid 31*a* to provide ample clearance from the strip 19*a*.

In the embodiment illustrated, the label 41*a* is elongated, and this is the type of label which the label applicator 11*a* is particularly adapted to apply. By locating the peeling bar 25*a* intermediate the ends of the grid 31*a*, the removed elongated label 41*a* partially confronts the grid and extends beyond the grid. The label 41*a* is retained against the grid 31 by the vacuum within the housing 29*a*. The mask 92 covers the grid 31*a* rearwardly of the peeling bar 25*a* to maximize the vacuum at the portion of the grid at which the label 41*a* is retained. The mask 92 may be, for example, a sheet having a pressure sensitive adhesive backing.

The conveyor 45*a* conveys containers 43*a* toward the label 41*a*. A stationary guide 97 is mounted above the conveyor 45*a* to direct the container 43*a* against the label 41*a* and an endless rotating belt 99. Thus, the guide 97 directs the peripheral wall of the container 43*a* against the adhesive side of the label 41*a* to initiate the label application process. With the container 43*a* positioned between the moving belt 99 and the stationary guide 97, the force of friction of the belt against the label and the peripheral wall of the container 43*a* causes the container 43*a* to rotate as the conveyor 45*a* moves the container by the belt 99. Rotation of the container 43*a* causes the full length of the label 41*a* to be pressed against the peripheral wall of the container. The operation of a wraparound label applicator such as the applicator 11*a* is known per se. However, by being able to adjust the location of the peeling bar 25*a*, the applicator section 27 can be used for spot labelling as illustrated in FIGS. 1–6 or for wraparound labelling as shown in FIGS. 7–10.

Although exemplary embodiments of the invention have been shown and described, many changes, modifications and substitutions may be made by one having ordinary skill in the art without necessarily departing from the spirit and scope of this invention.

We claim:

1. A label applicator for applying labels to articles wherein the labels are supplied on a backing strip, said label applicator comprising:

a supporting structure;

a supply reel mounted for rotation on the supporting structure and adapted to have the backing strip wound thereon;

a takeup reel mounted for rotation on the supporting structure, the backing strip adapted to extend from the supply reel to the takeup reel and to be wound on the takeup reel;

drive means for moving the backing strip from the supply reel to the takeup reel;

a peeling bar, said backing strip extending at least part way around the peeling bar whereby the peeling bar can remove labels from the backing strip;

a grid mounted on the supporting structure;

vacuum means for releasably retaining the removed labels against the grid; and means for mounting the peeling bar at any of a plurality of spaced locations along the grid whereby the location of the peeling bar along the grid can be adjusted to accommodate different labeling requirements.

2. A label applicator as defined in claim 1 wherein said last mentioned means includes a track mounted on the supporting structure and extending along one side of the grid, and means for releasably attaching said peeling bar to said track at said locations.

3. A label applicator as defined in claim 2 including a spacer selectively interposable between the peeling bar and the track to change the position of the peeling bar relative to the grid in the direction of the axis of the grid.

4. A label applicator as defined in claim 1 including means for changing the position of the peeling bar in a direction axially of the grid.

5. A label applicator as defined in claim 1 including mask means for blocking off a portion of said grid.

6. A label applicator as defined in claim 5 wherein said mask is adjustable along the grid whereby the portion of said grid which is blocked off can be adjusted.

7. A label applicator for applying a label to an article comprising:

a housing including a gas pervious wall, said housing being adapted to be maintained at a pressure less than atmospheric;

means for supplying a label to said pervious wall with the reduced pressure in said housing releasably holding said label against the pervious wall;

a manifold defining a chamber therein, said chamber being adapted to receive a gas under pressure, said manifold being in said housing;

said manifold having a manifold wall with a plurality of ports therein communicating with said chamber;

means for blocking off a first group of said ports, at least a portion of said blocking means being removable to unblock at least one of the ports of said first group of ports;

a plurality of tubes removably attached to said manifold and extending from a second group of ports toward said pervious wall, each of said tubes terminating at a location outside of said pervious wall and within said housing, each of said tubes having a passage therein extending from said manifold and terminating in an outlet section, each of said outlet sections being outside of said pervious wall and within said housing, said passages being capable of transmitting a blast of gas from said chamber toward said label whereby said label is removed from said pervious wall and is applied to the article;

the outlet section of each of said passages being of lesser cross sectional area than the region of such passage contiguous the outlet section; and said supplying means includes a peeling bar adjacent said pervious wall and means for retaining said peeling bar in any one of a plurality of different positions.

8. A label applicator for applying labels to articles wherein the labels are supplied on a backing strip, said label applicator comprising:

a housing including a gas pervious wall, said housing being adapted to be maintained at a pressure less than atmospheric;

a peeling bar adapted to have the backing strip extend at least part way around the peeling bar;

means for moving the backing strip over the peeling bar whereby a first of the labels is removed from the backing strip by the peeling bar and moved in a first direction onto the pervious wall, the reduced pressure in said housing releasably holding the first label against the pervious wall;

means for retaining the peeling bar at any of at least first and second locations, said locations being adjacent said gas pervious wall;

said second location being spaced in said first direction from said first location, said peeling bar extending at least part way across the pervious wall intermediate the ends of the pervious wall in at least one of said locations; and means for removing the first label from the pervious wall and applying it to one of the articles.

9. A label applicator as defined in claim 8 including means for changing the position of the peeling bar in a direction generally transverse to the pervious wall.

10. A label applicator for applying labels to articles wherein the labels are supplied on a backing strip, said label applicator comprising:

a supporting structure;

a wall mounted on the supporting structure;

a peeling bar adapted to have the backing strip extend at least part way around the peeling bar;

means for moving the backing strip over the peeling bar whereby a first of the labels is removed from the backing strip by the peeling bar and moved onto the wall;

means on the supporting structure for releasably holding the first label on said wall;

means for retaining the peeling bar at any of a plurality of locations, said locations being adjacent said wall;

a first of said locations being spaced from a second of said locations so that the location of a label on said wall which is removed from the backing strip when the peeling bar is in said first location is different from the location of a label on said wall which is removed from the backing strip when the peeling bar is in said second location, said peeling bar extending at least part way across the wall intermediate the ends of the wall in at least one of said first and second locations; and means for removing the first label from said wall and applying it to one of the articles.

* * * * *